US011618974B2

(12) United States Patent
Sugimoto et al.

(10) Patent No.: US 11,618,974 B2
(45) Date of Patent: Apr. 4, 2023

(54) ELECTROSPINNING APPARATUS

(71) Applicant: KABUSHIKI KAISHA TOSHIBA, Tokyo (JP)

(72) Inventors: Kanta Sugimoto, Yokohama (JP); Kenichi Ooshiro, Yokohama (JP); Kenya Uchida, Yokohama (JP); Shizuo Kinoshita, Yokohama (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 0 days.

(21) Appl. No.: 17/360,268

(22) Filed: Jun. 28, 2021

(65) Prior Publication Data

US 2022/0106709 A1 Apr. 7, 2022

(30) Foreign Application Priority Data

Oct. 1, 2020 (JP) ..... JP2020-167123

(51) Int. Cl.
*D01D 5/00* (2006.01)
*B05B 5/025* (2006.01)

(52) U.S. Cl.
CPC ..... *D01D 5/0061* (2013.01); *D01D 5/003* (2013.01); *B05B 5/025* (2013.01)

(58) Field of Classification Search
CPC ..... D01D 4/06; D01D 5/0084; D01D 5/0092; D01D 5/0076; D01D 5/0069; D01D 5/0003; D01D 5/0061; D05B 5/00
See application file for complete search history.

(56) References Cited

U.S. PATENT DOCUMENTS

2009/0221206 A1* 9/2009 Gerking ..... D01D 5/14 425/72.2
2013/0168886 A1* 7/2013 Sumida ..... B29D 99/0078 264/10
2017/0268129 A1* 9/2017 Uchida ..... B05B 15/68
2018/0250718 A1* 9/2018 Sakai ..... B05B 5/1608
2022/0106710 A1* 4/2022 Ooshiro ..... D01D 5/003

FOREIGN PATENT DOCUMENTS

JP 2013-155457 8/2013
JP 2017-145533 8/2017
JP 2018-145551 9/2018

* cited by examiner

*Primary Examiner* — Emmanuel S Luk
(74) *Attorney, Agent, or Firm* — Oblon, McClelland, Maier & Neustadt, L.L.P.

(57) ABSTRACT

According to an embodiment, an electrospinning apparatus includes an electrospinning head and a storage case. The electrospinning head includes a nozzle capable of ejecting a material liquid and is movable between a first move position and a second move position. In the storage case, a storage hollow capable of accommodating a nozzle is formed, and an opening to the outside of the storage hollow is formed in the storage case. The storage case causes the nozzle of the electrospinning head located at the first move position to be arranged at a position separate from the storage hollow and causes the nozzle of the electrospinning head located at the second move position to be accommodated inside the storage hollow.

7 Claims, 5 Drawing Sheets

ELECTROSPINNING APPARATUS

CROSS-REFERENCE TO RELATED APPLICATIONS

This application is based upon and claims the benefit of priority from Japanese Patent Application No. 2020-167123, filed Oct. 1, 2020, the entire contents of which are incorporated herein by reference.

FIELD

Embodiments described herein relate to an electrospinning apparatus.

BACKGROUND

An electrospinning apparatus that accumulates microfibers on a surface of a collection body or a substrate to form a fiber film with an electrospinning method (sometimes called "electric charge induction spinning method"). In the electrospinning apparatus, an electrospinning head is supplied with a material liquid including a high polymer material. A voltage is applied to the electrospinning head so as to electrify the liquid material, and the electrified liquid material is ejected against the surface of a collection body or a substrate from a nozzle of the electrospinning head. Fiber is thereby accumulated on the surface of the collection body or the substrate.

In such an electrospinning apparatus, when the work to form a fiber film is not being conducted, the nozzle of the electrospinning apparatus is, for example, accommodated inside of a storage case for protection. It is desired that the function of accommodating a nozzle inside a storage case be automated to the greatest extent. Considering automating the accommodation of the nozzle inside the storage case, it is preferred that complicated structures, such as an electric actuator and/or circuitry that may be affected with relatively high voltage applied to the electrospinning head, are prevented. In other words, it is desired that the automation of accommodating the nozzle in the storage case be realized with a simple structure such as a mechanical structure.

DETAILED DESCRIPTION

According to an embodiment, an electrospinning apparatus includes an electrospinning head and a storage case. The electrospinning head includes a nozzle capable of ejecting a material liquid including a high polymer material, and the electrospinning head is movable between a first move position and a second move position. In the inside of the storage case, a storage hollow capable of accommodating the nozzle of the electrospinning head, and an opening to the outside of the storage hollow are formed in the storage case. The storage case causes the nozzle of the electrospinning head located at the first move position to be arranged at a position separate from the storage hollow. The storage case also causes the nozzle of the electrospinning head located at the second move position to be accommodated inside of the storage hollow.

Hereinafter, the embodiments will be described with reference to the accompanying drawings.

First Embodiment

Figure 1:
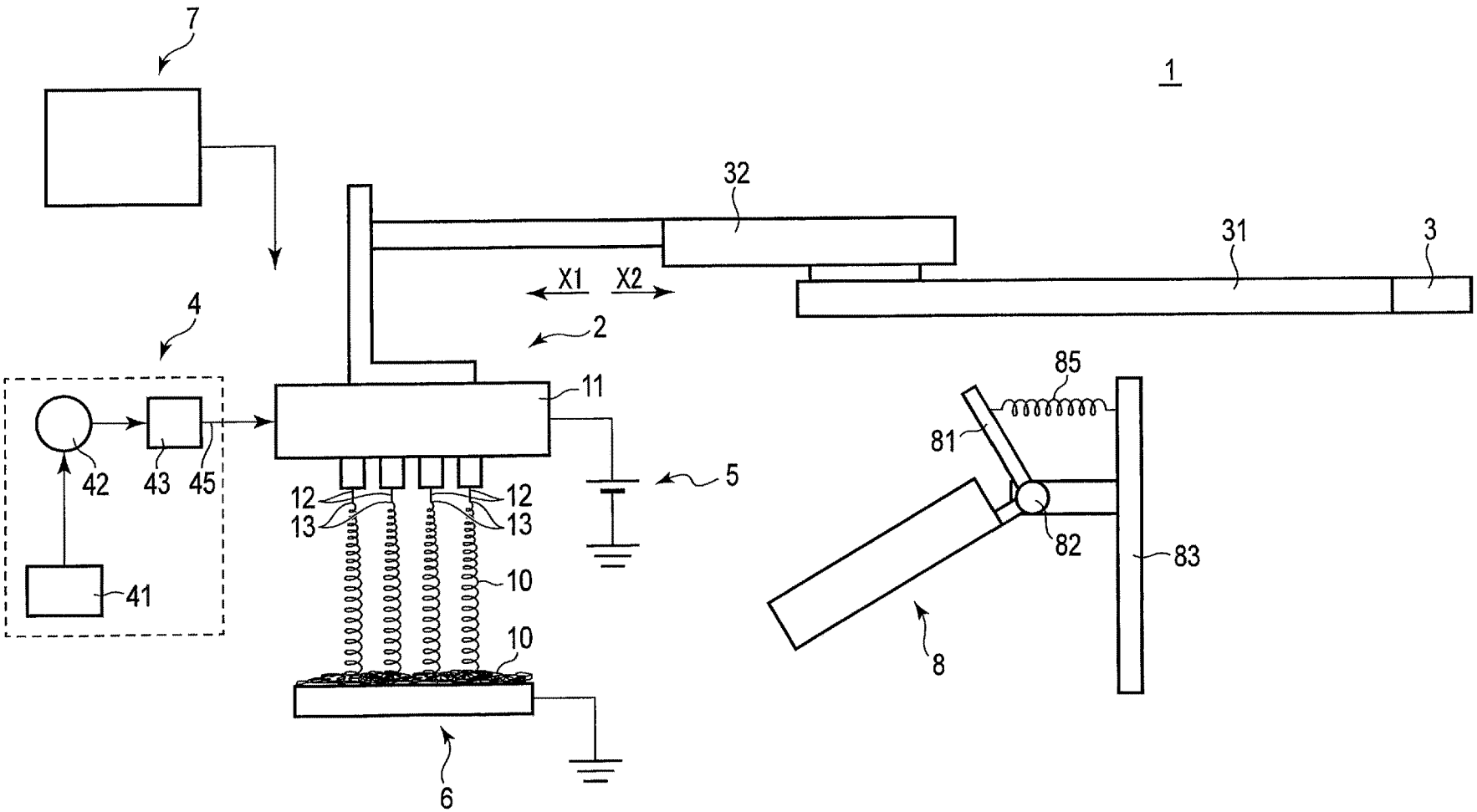
FIG. 1 is a schematic diagram of an electrospinning apparatus according to a first embodiment in a state in which its electrospinning head is located at a first move position, viewed from a direction intersecting a center axis of the electrospinning head and intersecting a projecting direction of nozzles.
Figure 2:
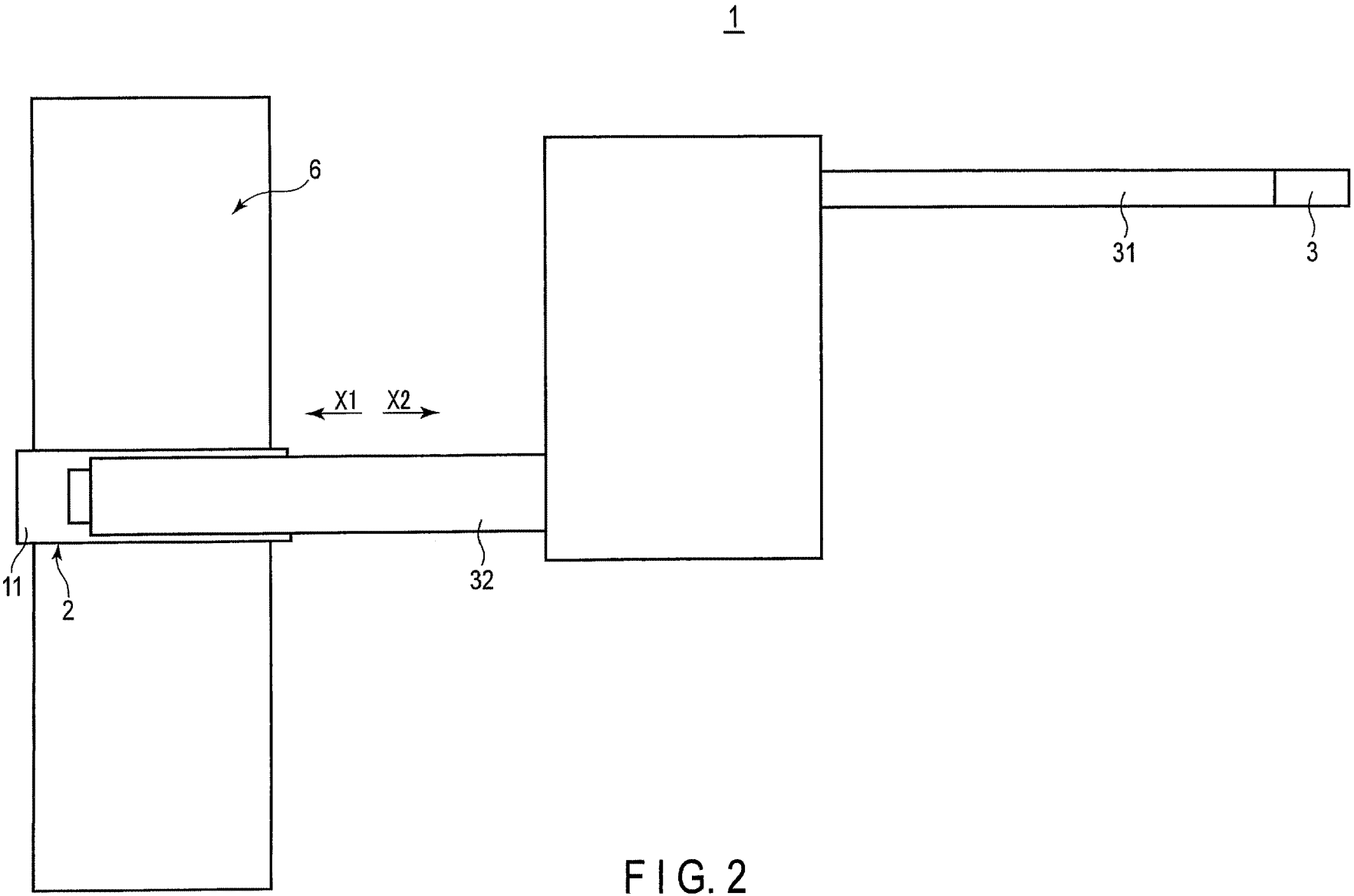
FIG. 2 is a schematic diagram of the electrospinning apparatus according to the first embodiment in a state in which the electrospinning head is located at the first move position, viewed from a side opposite to the projecting direction of the nozzles.
Figure 3:
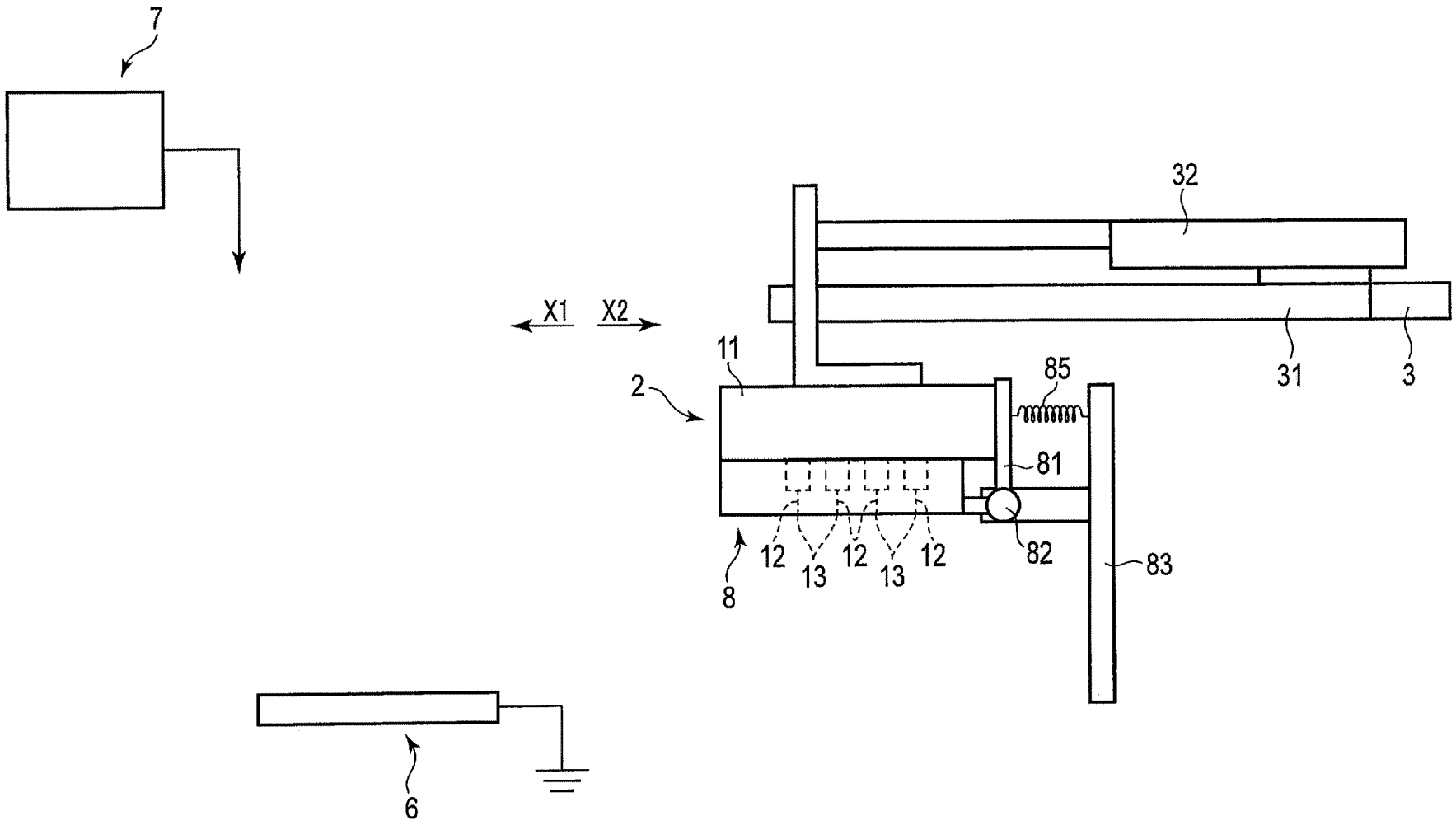
FIG. 3 is a schematic diagram of an electrospinning apparatus according to the first embodiment in a state in which its electrospinning head is located at a second move position, viewed from a direction intersecting the center axis of the electrospinning head and intersecting the projecting direction of the nozzles.

FIGS. 1 through 3 show an example of an electrospinning apparatus 1 according to the first embodiment. As shown in FIGS. 1 to 3, the electrospinning apparatus 1 includes an electrospinning head 2, a movement driver 3, a supply source (supplier) 4 of a material liquid, a power supply source 5, a collection body 6, a controller 7, and a storage case 8.

The electrospinning head 2 includes a head main body 11 and one or more (four in the present embodiment) nozzles 12. Herein, the center axis of the head main body 11 (electrospinning head 2) is defined, and the direction along the center axis of the head main body 11 is defined as a longitudinal direction. The head main body 11 extends along the center axis and extends in the longitudinal direction. In the present embodiment, each of the head main body 11 and the nozzles 12 is made of an electrically conductive material. The number of the nozzles 12 is not limited particularly, and at least one nozzle will suffice. Preferably, the head main body 11 and each of the nozzles 12 are respectively made of materials having resistance against a material liquid, and may be made of stainless steel, for example.

Each of the nozzles 12 is provided on the outer peripheral surface of the head main body 11. Each of the nozzles 12 projects from the outer peripheral surface of the head main body 11 toward the outer periphery, namely toward the side away from the center axis of the head main body 11. In the present embodiment, the plurality of nozzles 12 are arranged at the same, or substantially the same, angle positions in a direction around the center axis of the head main body 11. For this reason, in the present embodiment, the plurality of nozzles 12 are arranged along the longitudinal axis of the electrospinning head 2 and constitute a nozzle row. FIGS. 1 and 3 show a state viewed in a direction intersecting the center axis (longitudinal direction) of the electrospinning head 2 and intersecting the projecting direction of the nozzles 12. FIG. 2, on the other hand, shows a state viewed from a side opposite to the projecting direction of the nozzles 12.

In the inside of the head main body 11, an inner hollow (not shown) is formed. In the inside of each nozzle 12, a flow passage (not shown) is formed, and an ejection port 13 is formed at the projecting end (distal end) of each nozzle 12 projecting from the head main body 11. In each nozzle 12, the ejection port 13 communicates with the inner hollow of the head main body 11. Each nozzle 12 can eject a material liquid from its ejection port 13. In each nozzle 12, a material liquid can be ejected toward the side on which the nozzle projects from the head main body 11, namely toward the side at which the ejection port 13 opens.

The movement driver 3 includes a driving member such as an electric motor, etc., supplied with the electric power with which the driving member is driven. The movement driver 3 is coupled to the electrospinning head 2 via the supporting body 31 and the movable body 32. The movable body 32 is connected to the supporting body 31 in such a manner that the movable body 32 is movable with respect to the supporting body 31 and the movement driver 3, together with the electrospinning head 2. In the example shown in FIGS. 1 to 3, the electrospinning head 2 and the movable body 32 are movable relative to the supporting body 31 and the movement driver 3 (arrows X1 and X2), along the longitudinal direction of the electrospinning head 2 (the center axis of the electrospinning head 2). The electrospinning head 2 is moveable between a first move position and a second move position.

Herein, FIGS. 1 and 2 show the electrospinning head 2 located at the first move position, and FIG. 3 shows the electrospinning head 2 located at the second move position. In the present embodiment, the movement driver 3 is driven so as to transmit power to the movable body 32 and the electrospinning head 2 via the supporting body 31, and the movable body 32 and the electrospinning head 2 are thereby moved. Since the electrospinning head 2 is coupled to the movement driver 3 via the supporting body 31 and the movable body 32, the movement driver 3 is located separate from the electrospinning head 2 regardless of the position of the electrospinning head 2. Thus, the driving member, such as an electric motor, etc. provided in the movement driver 3 is located separate from the electrospinning head 2, regardless of the position of the electrospinning head 2. Furthermore, at the first move position, the electrospinning head 2 is located further away from the movement driver 3 than it is at the second move position.

The supplier 4 of a material liquid can supply a material liquid to the electrospinning head 2 when the electrospinning head 2 is located at the first move position. When the electrospinning head 2 is at a position other than the first move position, for example at the second move position, the supplier 4 does not supply a material liquid to the electrospinning head 2. The supplier 4 constitutes a supply source of a material liquid and a supply passage for a material liquid from the supply source to the electrospinning head 2. The supplier 4 of a material liquid includes a storage unit 41, a supply driver 42, a supply adjuster 43, and a supply pipe 45. Each of the storage unit 41, the supply driver 42, the supply adjuster 43, and the supply pipe 45 has resistance to a material liquid, and in one example, each of the storage unit 41 and the supply pipe 45 is made of a material having electrically insulating properties, such as a fluorine resin.

The storage unit 41 is a reservoir, etc. for storing a material liquid. A material liquid is a solution of a high polymer material in a solvent. The high polymer included in the material liquid, and the solvent in which the high polymer is dissolved are determined as appropriate in accordance with the type, etc. of fiber 10 to be accumulated on the surface of the collection body 6. The high polymer material is not limited to a specific type, and any type can be used as appropriate according to material properties of the fiber 10 to be formed. The examples of the high polymer material are: polypropylene, polyethylene, polystyrene, polyethylene terephthalate, polyvinyl chloride, polycarbonate, nylon, aramid, etc. Any solvent may be used for a material liquid as long as a high polymer material can be dissolved therein. The solvent can be changed as appropriate in accordance with the high-polymer material to be dissolved. As the solvent, for example, water, methanol, ethanol, isopropyl alcohol, acetone, benzene, toluene, N-methyl-2-pyrrolidone (NMP), and dimethylacetamide (DMAc), etc. can be used.

The supply pipe 45 couples the storage unit 41 to the electrospinning head 2 so as to form a supply passage for the liquid material. The supply driver 42 is driven to supply a material liquid to the electrospinning head 2 from the storage unit 41 through the supply pipe 45. In one example, the supply driver 42 is a pump. The supply adjuster 43 adjusts an amount of flow and pressure, etc. of the material liquid supplied to the electrospinning head 2. In one example, the supply adjuster 43 includes a controlling valve capable of controlling an amount of flow and pressure, etc. of a material liquid. In this case, the supply adjuster 43 adjusts the amount of flow and pressure, etc. of the material liquid as appropriate based on material liquid viscosity and the structure of the nozzle 12, and the like. In one example, the supply adjuster 43 is capable of switching between supply and non-supply of the material liquid from the storage unit 41 to the electrospinning head 2. In this case, the supply adjuster 43 includes, for example, a switching valve.

In the present embodiment, the power supply source 5 applies a voltage to the electrospinning head 2 when the electrospinning head 2 is located at the first move position. At this time, in the electrospinning head 2, a voltage of a predetermined polarity is applied to each nozzle 12 through the head main body 11. Furthermore, a voltage of the same polarity is applied to respective nozzles 12. In a state in which a material liquid is supplied to the electrospinning head 2 by the supplier 4, a voltage is applied to the electrospinning head 2 by the power supply source 5 as described above, and the material liquid is thereby electrified in the same polarity as the nozzles 12 (electrospinning head 2). In the present embodiment, when the electrospinning head 2 is located at a position other than the first move position, for example at the second move position, a voltage is not applied to the nozzles 12 (electrospinning head 2) by the power supply source 5. When the electrospinning head 2 is at a position between the first move position and the second move position, the power supply source 5 may be operated to apply a voltage to the electrospinning head 2.

In one example, a terminal (not shown) electrically connected to each nozzle 12 is provided, and the power supply source 5 may apply a voltage to each nozzle 12 through the terminal. In this case, the head main body 11 is not necessarily made of an electrically conductive material. The polarity of the voltage applied to each nozzle 12 may be positive or negative. In the example shown in FIG. 1, the power supply source 5 is a direct current power source and applies a positive voltage to each nozzle 12.

The collection body 6 is made of an electrically conductive material. The collection body 6 has resistance against a material liquid, and in one example, is made of stainless steel. When the electrospinning head 2 is located at the first move position, the collection body 6 is arranged, with respect to the electrospinning head 2, on the side where the nozzles 12 project and to which a material liquid is ejected from the nozzles 12. In the example of FIG. 1, the collection body 6 is grounded and the voltage of the collection body 6 relative to the ground is 0 V or approximately 0 V. In another example, voltages of the polarity opposite to the polarity of the voltages applied to a material liquid and the electrospinning head 2 (nozzles 12) are applied to the collection body 6 by either the power supply source 5 or another power supply source.

In the present embodiment, through the application of voltages to the electrospinning head 2, a material liquid supplied to the electrospinning head 2 is electrified with the same polarity as the electrospinning head 2. Furthermore, when the electrospinning head 2 is located at the first move position, the material liquid is electrified by the same polarity as the electrospinning head 2 and thereby ejected from the ejection port 13 of each nozzle 12 toward the collection body 6 by an electric potential difference between the electrified material liquid of the electrospinning head 2 (nozzles 12) and the collection body 6. As a result of the ejection of the material liquid from the electrospinning head 2 toward the collection body 6, fiber 10 is accumulated on the surface of the collection body 6 and the accumulated fiber 10 is thereby formed into a film of the fiber 10. In other words, the film of the fiber 10 is formed by an electrospinning method (sometimes referred to as "electric charge induction spinning method"). The voltages applied to the nozzles 12 (electrospinning head 2), the voltage applied to the collection body 6, and the like are adjusted as appropriate in accordance with a type of the high polymer material contained in the material liquid and a distance between the electrospinning head 2 and the collection body 6, etc.

The collection body 6 is formed in a plate-like shape or a sheet-like shape, for example. In the case where the collection body 6 is formed in a sheet-like shape, the fiber 10 may be accumulated on the collection body 6 rolled around the outer peripheral surface of a roll or the like. The collection body 6 may be movable. In one example, a pair of rotating drums, and its drive source, is provided. Driving of the rotating drums by the drive source causes the collection body 6 to be moved between them in a manner similar to a conveyor belt. Through the moving (transfer) of the collection body 6, it is possible to change the area where the fiber 10 is accumulated on the surface of the collection body 6 over time. The film of the fiber 10 formed on the surface of the collection body 6 is removed from the collection body 6. The film of the fiber 10 is used as a nonwoven fabric or a filter, etc., but the usage is not limited thereto.

In one example, the collection body 6 is not provided. In this case, a substrate made of an electrically conductive material is used. With a material liquid being supplied to the electrospinning head 2 in the above-described manner, a voltage is applied to the electrospinning head 2, and the material liquid is ejected from the ejection port 13 of each nozzle 12 toward the substrate. Thus, the fiber 10 is accumulated on the surface of the substrate, and a film of the fiber 10 is formed on the surface of the substrate. In this case, the substrate may be grounded, and a voltage of an opposite polarity to the voltage applied to the electrospinning head 2 (nozzles 12) may be applied to the substrate either by the power supply source 5 or another power supply source.

In another example, a substrate is placed on the collection body 6. With a material liquid being supplied to the electrospinning head 2 in the above-described manner, a voltage is applied to the electrospinning head 2, and the material liquid is ejected from the ejection port 13 of each nozzle 12 toward the collection body 6 and the substrate. Thus, the fiber 10 is accumulated on the surface of the substrate placed on the collection body 6, and a film of the fiber 10 is formed on the surface of the substrate. In this case, even if the substrate has electrically insulating properties it is possible to form a film of the fiber 10 on the surface of the substrate.

In the case where the substrate is arranged on the collection body 6, the substrate may be movable on the collection body 6. In one example, a rotating drum around which the substrate in a sheet-like shape is rolled, and a rotating drum that winds around itself the substrate on which the film of the fiber 10 is formed are provided. Furthermore, the substrate is moved on the collection body 6 through the rotation of each rotating drum. Through the moving (transfer) of the substrate, it is possible to change the area where the fiber 10 is accumulated on the surface of the substrate over time. As an example where the film of the fiber 10 is formed on the surface of the substrate, although not limited thereto, manufacturing of a separator-integrated type electrode for a battery is known. In this case, either one of the negative electrode or the positive electrode of an electrode group may be used as the substrate. The film of the fiber 10 formed on the surface of the substrate serves as a separator integrated with the negative electrode or the positive electrode.

The controller 7 is a computer, for example. The controller 7 includes a processor or an integrated circuit (control circuit) including a CPU (central processing unit), an ASIC (application specific integrated circuit), or an FPGA (field programmable gate array), and a storage medium, such as a memory. The controller 7 may include only one integrated circuit, etc., or a plurality of integrated circuits, etc. The controller 7 performs processing by executing a program, etc. stored on the storage medium, etc. The controller 7 controls the driving of the supply driver 42, the operation of the supply adjuster 43, and the output of the power supply source 5, etc. The controller 7 controls the driving of the movement driver 3 so as to control the movement of the electrospinning head 2 between the first move position and the second move position.

The storage case 8 is attached to the supporting body 83, with the relay link 81 and the shaft member 82 interposed therebetween. The storage case 8 is rotatable around the shaft member 82 relative to the supporting body 83, together with the relay link 81. The rotation axis of the storage case 8 intersects (is orthogonal or approximately orthogonal to) the moving direction of the electrospinning head 2. The relay link 81 is connected to one end of the spring member 85, and the supporting body 83 is connected to the other end of the spring member 85.

In the present embodiment, when the electrospinning head 2 is moved to the second move position, the electrospinning head 2 is made to abut the relay link 81. As a result, a force is applied to the relay link 81 by the electrospinning head 2 which causes the relay link 81 and the electrospinning head 2 to rotate around the shaft member 82. Consequently, the nozzles 12 of the electrospinning head 2 located at the second move position are inserted into the inside of the storage case 8. Thus, in the present embodiment, the relay link 81 and the shaft member 82, etc. constitute a case moving unit that moves the storage case 8 by a force applied by the electrospinning head 2. Furthermore, in the state where the electrospinning head 2 is located at the second move position, the storage case 8 is moved to, by mechanical force applied to the relay link 81 of the case moving unit by the electrospinning head 2, an accommodating position at which the storage case 8 accommodates the nozzles 12 of the electrospinning head 2 located at the second move position. In other words, the storage case 8 causes the nozzles 12 of the electrospinning head 2 located at the second move position to be accommodated inside the storage case 8 (namely, inside the storage hollow 86).

In a state in which the electrospinning head 2 is located at a position distant from the second move position, for example the first move position, the electrospinning head 2 is not in contact with the relay link 81, and the electrospinning head 2 does not apply a force to the relay link 81 of the case moving unit. In a state in which the electrospinning head 2 does not apply a force to the relay link 81, the storage case 8 is retained by elasticity, etc. of the spring member 85 acting on the relay link 81, at a position distant from an accommodation position for the nozzles 12 of the electrospinning head 2 located at the second move position. In other words, in a state in which the electrospinning head 2 does not apply a force to the relay link 81, the storage case 8 is energized by the spring member 85 so as to be located at a position distant from the accommodation position. In other words, the storage case 8 causes the nozzles 12 of the electrospinning head 2 located at the first move position to be located at a position distant from the inside of the storage case 8 (namely, the storage hollow 86).

Therefore, in the present embodiment, the spring member 85, etc. constitutes a case retaining unit that retains the storage case 8 at a position distant from the accommodation position in a state in which no force is applied to the relay link 81 of the case moving unit by the electrospinning head 2. Furthermore, in the present embodiment, a force applied to the relay link 81 by the electrospinning head 2 causes the storage case 8 to move to the accommodation position against the elasticity, etc. of the spring member 85.

Figure 4:
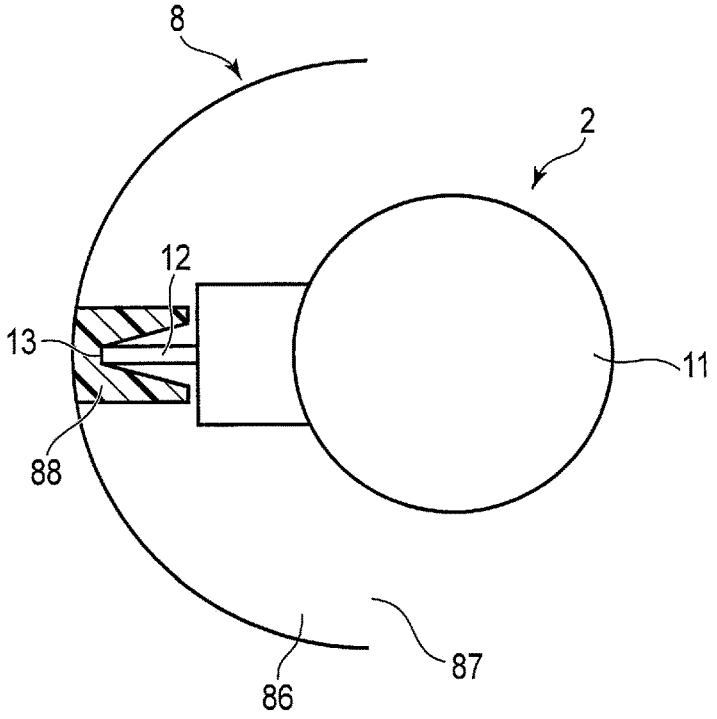
FIG. 4 is a schematic diagram of the electrospinning apparatus according to the first embodiment in a state in which the nozzles of the electrospinning head located at the second move position are accommodated in a storage case.

FIG. 4 shows a state in which the nozzles 12 of the electrospinning head 2 located at the second move position are accommodated in the storage case 8. FIG. 4 shows the electrospinning head 2 viewed from one side of the longitudinal direction. As shown in FIG. 4, the storage hollow 86 is formed inside the storage case 8, and the nozzles 12 of the electrospinning head 2 can be accommodated in the storage hollow 86. An opening 87 to the outside of the storage hollow 86 is formed in the storage case 8. When the electrospinning head 2 is moved to the second move position and the storage case 8 is moved in the above-described manner by the force applied to the relay link 81 of the case moving unit by the electrospinning head 2, the nozzles 12 are inserted into the storage hollow 86 from the opening 87.

The storage case 8 defines a longitudinal axis. In the storage case 8, the storage hollow 86 and the opening 87 are formed along the longitudinal direction. In the state in which the nozzles 12 of the electrospinning head 2 located at the second move position are accommodated, the longitudinal direction of the storage case 8 corresponds or approximately corresponds to the longitudinal direction of the electrospinning head 2 and the moving direction of the electrospinning head 2. In the storage case 8, the storage hollow 86 opens at the opening 87 toward the direction intersecting (perpendicular or approximately perpendicular to) the longitudinal direction. Then, in the storage case 8, a bottom surface (a bottom part) is formed on the side opposite to the opening 87 in the direction intersecting (perpendicular or approximately perpendicular to) the longitudinal direction. In other words, in the storage case 8, the bottom surface is formed at a position distant from the opening 87 by about 180 degrees in the circumferential direction. In a state in which the nozzles 12 of the electrospinning head 2 located at the second move position are accommodated, the storage hollow 86 opens at the opening 87 in the direction opposite to the direction in which the nozzles 12 project.

In the storage hollow 86 of the storage case 8, caps 88 are provided in a number equal to the number of nozzles 12. In a state in which the nozzles 12 are accommodated in the storage hollow 86, each cap 88 is in tight contact with a single corresponding nozzle 12. Thus, in the present embodiment, each cap 88 constitutes a tight-contact portion with which a single corresponding nozzle 12 is in tight contact when the nozzles 12 are accommodated in the storage hollow 86. At the projection end of each nozzle 12 from the head main body 11 (the distal end), namely at the ejection port 13 and its vicinity, each nozzle 12 is in tight contact with a tight-contact portion which is a single corresponding cap 88.

Being in tight contact with a single corresponding cap 88, the outer peripheral side of each nozzle 12 is covered by the corresponding cap 88. The cap 88 has flexibility and is made of rubber. As the rubber from which the cap 88 is made, silicone rubber and ethylene propylene diene monomer (EPDM) rubber may be used. In the example shown in FIG. 4, the cross section of each cap 88 is in a shape having a concave portion, and projection end (the distal end) of the nozzle 12 projecting from the head main body 11 (namely, the ejection port 13 and its vicinity) is in tight contact with the concave bottom portion of the cap 88; however, the shape, etc. of the cap 88 is not limited to this example. Particularly, if rubber, such as silicone rubber and ethylene propylene diene monomer (EPDM) rubber, is used as the material that constitutes the caps 88, the cross section of each cap 88 is formed in a rectangular shape, and a distal end of the corresponding nozzle 12 may be in tight contact with each cap 88.

The nozzles 12, accommodated in the storage hollow 86 of the storage case 8 while each is in tight contact with a corresponding cap 88 as described above, can be properly protected by the caps (tight-contact portions) 88. In other words, in a state in which the forming of a fiber 10 film is not being performed by the electrospinning method, the nozzles 12 are accommodated while being properly protected. Since each nozzle 12 is in tight contact with a corresponding cap 88 made of rubber at the ejection port 13 and its vicinity, deposits of the material liquid in the flow path can be effectively prevented from solidifying in each nozzle 12.

In the present embodiment, as described above, a force is applied, by the electrospinning head 2, to the relay link 81 of the case moving unit by moving the electrospinning head 2 to the second move position, which then serves to move (rotate) the storage case 8. Furthermore, the movement of the storage case 8 causes the nozzles 12 to be inserted into the storage hollow 86 of the storage case 8. Thus, the automation of the function of accommodating the nozzles 12 in the storage case 8 can be realized.

Since the storage case 8 is moved by a force applied to the relay link 81 by the electrospinning head 2, the structure for accommodating the nozzles 12 inside the storage case 8 as a result of its movement does not become complicated. Thus, the automation of the function of accommodating the nozzles 12 in the storage case 8 can be realized with a simple structure.

Since the structure for accommodating the nozzles 12 inside the storage case 8 is uncomplicated, enlargement of the structure is effectively prevented. Since the storage case 8 is moved by the force applied to the relay link 81 by the electrospinning head 2, there is no necessity to provide a driving member driven by electric power, such as an electric motor, as a driving power source for moving the storage case 8. Thus, when a film of fiber 10 is formed by an electrospinning method, an influence caused by the structure for accommodating the nozzles 12 inside the storage case 8 on an electric field produced in the electrospinning head 2 and its vicinity can be reduced.

In a state in which the electrospinning head 2 is located at a position distant from the second move position, a force from the electrospinning head 2 is not applied to the relay link 81 of the case moving unit, and the storage case 8 is retained at a position distant from the accommodation position for accommodating the nozzles 12 by the spring member (case retaining unit) 85. Furthermore, the electrospinning head 2 is moved to the second move position, and a force applied to the relay link 81 by the electrospinning head 2 causes the storage case 8 to move to the accommodation position against the elasticity, etc. of the spring member 85. For this reason, by moving the electrospinning head 2 to the second move position, the relay link 81 and the storage case 8 are appropriately moved, and the nozzles 12 are appropriately accommodated in the storage case 8.

Furthermore, in the present embodiment, regardless of the position at which the electrospinning head 2 is located, the driving member, such as an electric motor, provided in the movement driver 3, is located separate from the electrospinning head 2. Furthermore, at the first move position, the electrospinning head 2 is located further away from the movement driver 3 than it is at the second move position. For this reason, when a film of fiber 10 is formed using the electrospinning head 2 located at the first move position, influences of the movement driver 3 on the electric field produced in the electrospinning head 2 and the vicinity thereof can be reduced.

(Modifications)

In the foregoing present embodiment, etc., the plurality of nozzles 12 are arranged along the longitudinal axis of the electrospinning head 2 and constitute a nozzle row; however, the arrangement of the nozzles 12 on the outer peripheral surface of the head main body 11 is not limited to the arrangement in the foregoing embodiment, etc. In the foregoing embodiment, etc., each nozzle 12 is in tight contact with a corresponding cap 88 when accommodated in the storage hollow 86; however, the structure of the tight-contact portion with which the nozzles 12 are in tight contact in the storage hollow 86 is not limited to that in the foregoing embodiment, etc.

Figure 5:
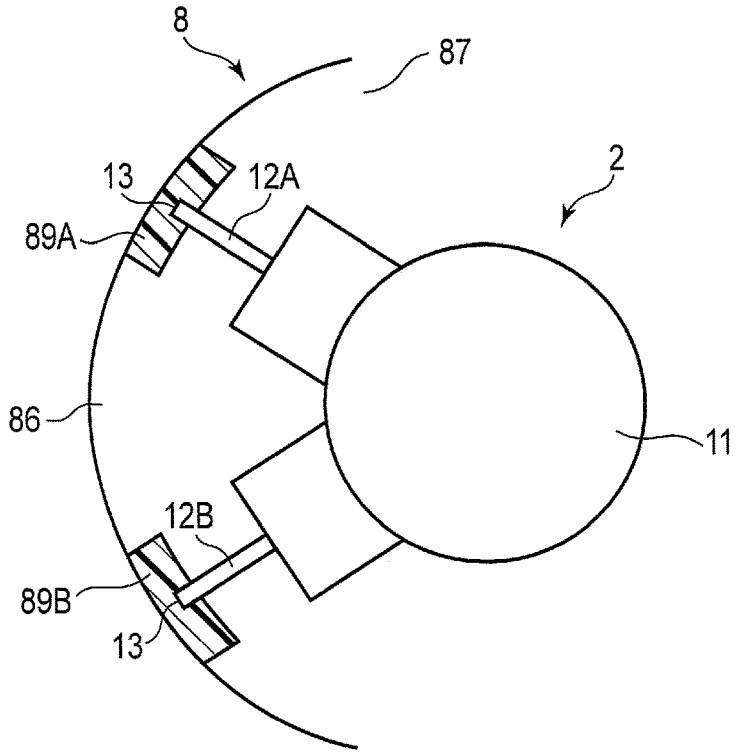
FIG. 5 is a schematic diagram of an electrospinning apparatus according to a first modification in a state in which nozzles of an electrospinning head located at the second move position are accommodated in a storage case.

In the first modification shown in FIG. 5, one or more nozzles 12A and one or more nozzles 12B are provided on the outer peripheral surface of the head main body 11. Each nozzle 12A and 12B projects from the outer peripheral surface of the head main body 11 toward the outer periphery side. The nozzles 12A and 12B are arranged separately from each other in the circumferential direction of the electrospinning head 2, in other words, in a direction around the center axis of the head main body 11. When the electrospinning head 2 is located at the first move position, all of the nozzles 12A and 12B are arranged on the side where the collection body 6 is located, relative to the center axis of the head main body 11. Furthermore, when the electrospinning head 2 is located at the first move position, a material liquid is ejected from each of the nozzles 12A and 12B toward the collection body 6.

In one example, a plurality of nozzles 12A are arranged in the longitudinal direction of the electrospinning head 2, constituting a nozzle row of the nozzles 12A. Similarly, a plurality of nozzles 12B are arranged in the longitudinal direction of the electrospinning head 2, constituting a nozzle row of the nozzles 12B. In this case, the nozzle row of the nozzles 12A and the nozzle row of the nozzles 12B are arranged separately from each other according to the circumferential direction of the electrospinning head 2.

In the present modification, similarly to the foregoing embodiment, the nozzles 12A and 12B are accommodated in the storage hollow 86 of the storage case 8. In the present modification, the sponges 89A and 89B are provided in the storage hollow 86, instead of the caps 88. In a state in which the nozzles 12A and 12B are accommodated in the storage hollow 86, each of the nozzles 12A is in tight contact with the sponge 89A and each of the nozzles 12B is in tight contact with the sponge 89B. Accordingly, in the present modification, each of the sponges 89A and 89B constitutes a tight-contact portion with which a corresponding nozzle 12A or 12B is in tight contact when the nozzles 12A and 12B are accommodated in the storage hollow 86. At the projection end of each nozzle 12A or 12B from the head main body 11 (the distal end), namely at the ejection port 13 and its vicinity, each nozzle 12A or 12B is in tight contact with a tight-contact portion which is constituted by a corresponding sponge 89A or 89B.

Each of the sponges 89A and 89B has flexibility and retains a solution. Each of the sponges 89A and 89B is made of a porous material such as a resin porous material or a high-polymer porous material, for example. The porous material of which each of the sponges 89A and 89B is made is, for example, a foaming material. For the purpose of retaining the solution, the foaming material that constitutes the sponges 89A and 89B may be an open-cell foam structure. As the foam material that forms the sponges 89A and 89B, a melamine foam or a polyurethane foam may be used, for example.

In each of the sponges 89A and 89B, the solution is retained in the pores or spaces inside the sponge. The solution retained by the sponges 89A and 89B is not limited to a particular type, as long as a high polymer material contained in the material liquid can dissolve in the solution. In one example, as the solution retained in the sponges 89A and 89B, the same liquid as the material liquid solvent is used. Thus, as the solution retained in the sponges 89A and 89B, water, methanol, ethanol, isopropyl alcohol, acetone, benzene, toluene, N-methyl-2-pyrrolidone (NMP), and dimethylacetamide (DMAc), etc. can be used.

Through being in tight contact with corresponding sponges 89A or 89B, the nozzles 12A and 12B accommodated in the storage hollow 86 of the storage case 8 are properly protected by the sponges (tight-contact portions) 89A and 89B, similarly to the foregoing embodiment, etc. In other words, in a state in which the forming of a film of the fiber 10 is not being performed by the electrospinning method, the nozzles 12A and 12B are accommodated while being properly protected. Each of the nozzles 12A and 12B is in tight contact with a corresponding sponge 89A or 89B at its ejection port 13 and the vicinity thereof; for this reason, the solidifying of a material liquid which has remained in a flow path may be effectively prevented in each of the nozzles 12A and 12B, similarly to the foregoing embodiment, etc.

Furthermore, in the present modification, droplets of the material liquid and a high polymer material of the material liquid deposited on the nozzles 12A and 12B dissolve in a solution retained in the sponges 89A and 89B. Thus, deposits of droplets of the material liquid and the high polymer material of the material liquid can be appropriately removed from each of the nozzles 12A and 12B. In other words, the nozzles 12A and 12B are cleaned with the solution, etc. retained in the sponges 89A and 89B.

Figure 6:
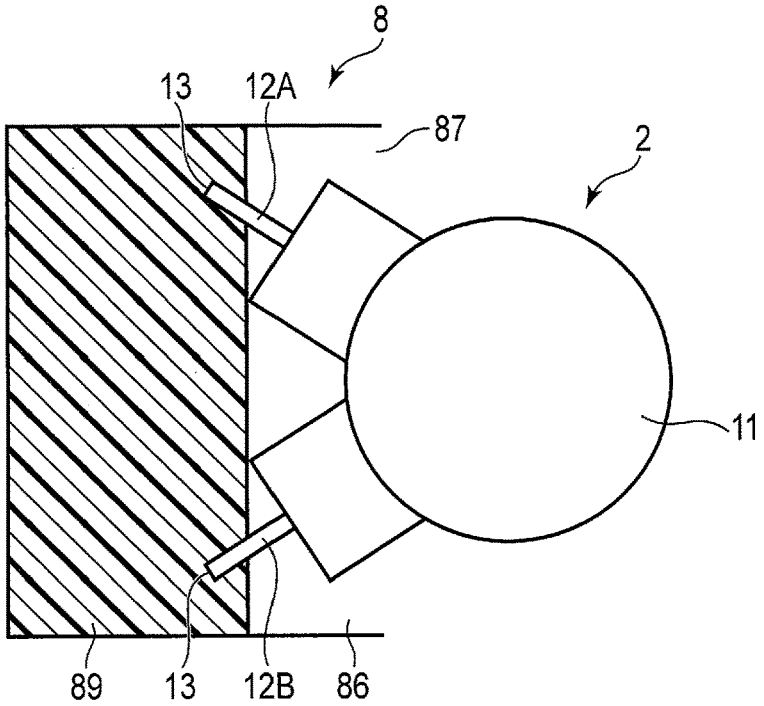
FIG. 6 is a schematic diagram of an electrospinning apparatus according to a second modification in a state in which nozzles of an electrospinning head located at the second move position are accommodated in a storage case.

In the second modification shown in FIG. 6, similarly to the first modification, etc., the nozzles 12A and 12B are arranged on the outer peripheral surface of the head main body 11. In the present embodiment, only one sponge 89 is arranged in the storage hollow 86 of the storage case 8. The sponge 89 has flexibility and retains a solution, similarly to the sponges 89A and 89B. In the present modification, in a state where the nozzles 12A and 12B are accommodated in the storage hollow 86, each of the nozzles 12A and 12B are in tight contact with the sponge 89. Accordingly, in the present modification, the sponge 89 constitutes a tight-contact portion with which the nozzles 12A and 12B are in tight contact when the nozzles 12A and 12B are accommodated in the storage hollow 86.

In the foregoing embodiment, etc., the bottom surface of the storage case 8 is formed as a curved surface; on the other hand, in the present modification, the bottom surface of the storage case 8 is formed as a flat surface. Thus, the shape of the storage case 8 differs between the present modification and the foregoing embodiment, etc. However, even in the present modification, an opening 87 of the storage hollow 86 is formed in the storage case 8. When the electrospinning head 2 is moved to the second move position and the storage case 8 is moved by the force applied to the case moving unit, such as the relay link 81, etc., by the electrospinning head 2, the nozzles 12A and 12B are inserted into the storage hollow 86 from the opening 87.

Figure 7:
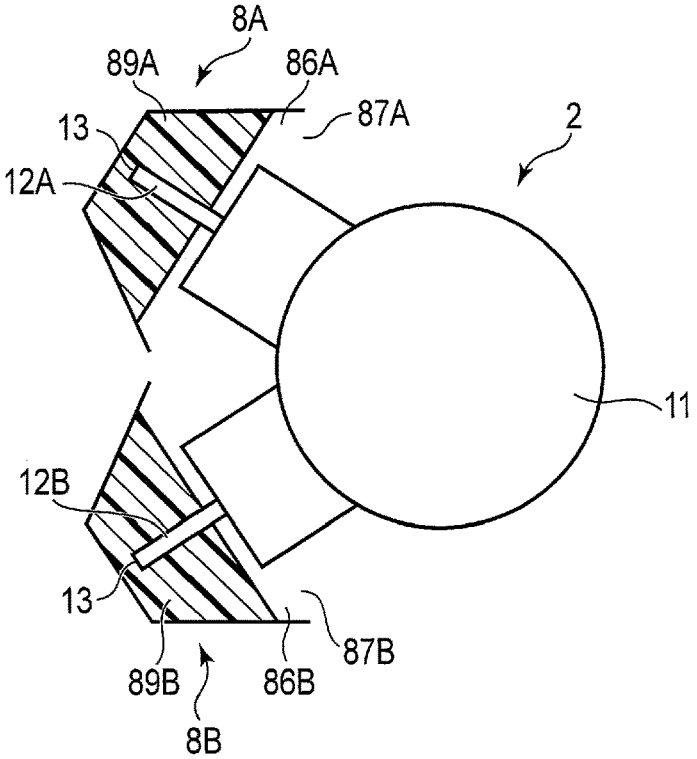
FIG. 7 is a schematic diagram of an electrospinning apparatus according to a third modification in a state in which nozzles of an electrospinning head located at the second move position are accommodated in a storage case.

In the third modification shown in FIG. 7, similarly to the first modification, etc., the nozzles 12A and 12B are arranged on the outer peripheral surface of the head main body 11. In the present modification, however, two storage cases 8A and 8B are provided. In the inside of the storage case 8A, a storage hollow 86A is formed, and an opening 87A to the outside of the storage hollow 86A is formed in the storage case 8A. In the inside of the storage case 8B, a storage hollow 86B is formed, and an opening 87B to the outside of the storage hollow 86B is formed in the storage case 8B. In the present modification, the above-described sponge 89A is arranged in the storage hollow 86A of the storage case 8A, and the above-described sponge 89B is arranged in the storage hollow 86B of the storage case 8B.

In the present modification, the electrospinning head 2 is moved to the second move position and a force is applied to the case moving unit, such as the relay link 81, etc., by the electrospinning head 2, and the storage cases 8A and 8B are thereby moved. Since the storage case 8A is moved by the force applied by the electrospinning head 2, the nozzles 12A are inserted into the storage hollow 86A through the opening 87A and thereby accommodated in the storage hollow 86A. The storage case 8B is moved by the force applied by the electrospinning head 2, and the nozzles 12B are inserted into the storage hollow 86B through the opening 87B and thereby accommodated in the storage hollow 86B.

In the present modification, in a state where the nozzles 12A are accommodated in the storage hollow 86A, each of the nozzles 12A is in tight contact with the sponge 89A. For this reason, the sponge 89A constitutes a tight-contact portion with which the nozzles 12A are in tight contact in a state in which the nozzles 12A are accommodated in the storage hollow 86A. Furthermore, in the state where the nozzles 12B are accommodated in the storage hollow 86B, each of the nozzles 12B is in tight contact with the sponge 89B. For this reason, the sponge 89B constitutes a tight-contact portion with which the nozzles 12B are in tight contact when the nozzles 12B are accommodated in the storage hollow 86B.

In the foregoing embodiment, etc., the material liquid is electrified by applying voltages to the nozzles (12; 12A, 12B) through the power supply source 5; however, a structure for electrifying a material liquid is not limited to this. In a modification, an electrically conductive part is provided in either a supply source of the material liquid to the electrospinning head 2 or a supply path between the supply source and the electrospinning head 2. In this case, for example, the storage unit 41 of the supplier 4 is made of an electrically conductive material, or the supply pipe 45 is partially made of an electrically conductive material so as to form a conductive part in the supplier 4. In this modification, the power supply source 5 applies a voltage to the conductive part of the supplier 4 to electrify the material liquid in the same polarity as the conductive part. The electrified material liquid is then supplied to the electrospinning head 2, and the material liquid is ejected from the ejection port 13 of each nozzle (12; 12A, 12B).

In any of the foregoing modifications, as a result of the movement of the electrospinning head 2 to the second move position, a force is applied to the case moving unit, such as the relay link 81, by the electrospinning head 2, causing the storage case (8; 8A, 8B) to be moved. Then, movement of the storage case (8; BA, 8B) results in the nozzles (12; 12A, 12B) of the electrospinning head 2 located at the second move position being inserted into the storage hollow (86; 86A, 86B) of the storage case (8; 8A, 8B). Thus, in any of the foregoing modifications, the automation of the function of accommodating the nozzles (12; 12A, 12B) into the storage case (8; 8A, 8B) can be realized by a simple structure, similarly to the first embodiment.

According to at least one of the foregoing embodiment and modifications, the electrospinning head is movable between the first move position and the second move position. Furthermore, the storage case causes the nozzles of the electrospinning head located at the first move position to be arranged at a position separate from the storage hollow and causes the nozzles of the electrospinning head located at the second move position to be accommodated inside the storage hollow. It is thereby possible to provide an electrospinning apparatus capable of easily accommodating nozzles into a storage case.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An electrospinning apparatus comprising:

an electrospinning head which is movable between a first move position and a second move position, and which includes a nozzle capable of ejecting a material liquid including a high polymer material;

a storage case inside which a storage hollow capable of accommodating the nozzle of the electrospinning head is formed, an opening of the storage hollow to an outside being formed in the storage case;

a support member configured to support the storage case at an accommodating position and a non-accommodating position different from the accommodating position, wherein the storage case is configured to be positioned at the non-accommodating position when the nozzle of the electrospinning head is located at the first move position and configured to be positioned at the accommodating position at which the storage case accommodates the nozzle of the electrospinning head located at the second move position on an inside of the storage hollow.

2. The electrospinning apparatus according to claim 1, further comprising:

a case moving unit which moves the storage case by a force applied by the electrospinning head when the electrospinning head moves to the second move position, and thereby facilitates insertion of the nozzle into the storage hollow of the storage case from the opening.

3. The electrospinning apparatus according to claim 2, further comprising:

a case retaining unit that retains the storage case at the non-accommodating position in a state in which no force is applied to the case moving unit by the electrospinning head.

4. The electrospinning apparatus according to claim 1, further comprising:

a tight-contact portion which is provided in the storage hollow of the storage case, and with which the nozzle is in tight contact when the nozzle is accommodated in the storage hollow.

5. The electrospinning apparatus according to claim 4, wherein the tight-contact portion is a cap including rubber or a sponge that retains a solvent into which the high polymer material included in the material liquid can be dissolved.

6. The electrospinning apparatus according to claim 1, further comprising:

a supplier that supplies the material liquid to the electrospinning head; and a power supply source which electrifies the material liquid, and which causes the nozzle to eject the electrified material liquid.

7. The electrospinning apparatus according to claim 2, wherein the case moving unit is configured to be rotated from the non-accommodating position to the accommodating position to insert the nozzle into the storage hollow of the storage case from the opening by the force applied by the electrospinning head.

* * * * *